US005865953A

United States Patent [19]

Rottger et al.

[11] Patent Number: 5,865,953

[45] Date of Patent: Feb. 2, 1999

[54] PAPER FOR CORRUGATING MEDIUM

[75] Inventors: Mark A. Rottger, Westford; Mark R. Leonard, Southborough, both of Mass.

[73] Assignee: Merrimac Paper Company, Inc., Lawrence, Mass.

[21] Appl. No.: 706,343

[22] Filed: Aug. 30, 1996

[51] Int. Cl.[6] ..... D21F 11/00; D21H 17/60

[52] U.S. Cl. ..... 162/184; 162/135; 162/158; 162/172; 162/164.1

[58] Field of Search ..... 162/184, 135, 162/169, 158, 164.3, 164.1, 172, 173

[56] References Cited

U.S. PATENT DOCUMENTS

| | | | |
|---|---|---|---|
| 2,229,620 | 1/1941 | Bradner | 162/184 |
| 2,993,800 | 7/1961 | Pickell | 162/172 |
| 3,033,708 | 5/1962 | McKee | 117/119.8 |
| 3,109,769 | 11/1963 | Martin | 162/164 |
| 3,119,731 | 1/1964 | Ströle et al. | 162/164 |
| 3,173,829 | 3/1965 | Thier et al. | 162/141 |
| 3,250,666 | 5/1966 | Clark et al. | 162/169 |
| 3,298,902 | 1/1967 | Osborg et al. | 162/158 |
| 3,307,994 | 3/1967 | Scott, Jr. | 156/210 |
| 3,308,006 | 3/1967 | Kresse et al. | 161/137 |
| 3,518,216 | 6/1970 | Harvey et al. | 260/28.5 |
| 3,525,668 | 8/1970 | Goldstein | 162/169 |
| 3,659,772 | 5/1972 | Dorsey et al. | 229/3.1 |
| 3,687,767 | 8/1972 | Reisman et al. | 156/210 |
| 3,849,224 | 11/1974 | Hintz et al. | 156/208 |
| 3,920,496 | 11/1975 | Wilkinson et al. | 156/82 |
| 4,038,122 | 7/1977 | DeLigt | 156/210 |
| 4,054,717 | 10/1977 | Gill et al. | 428/452 |
| 4,086,116 | 4/1978 | Yazaki et al. | 156/205 |
| 4,409,274 | 10/1983 | Chaplin et al. | 428/112 |
| 4,567,215 | 1/1986 | Jackson et al. | 523/218 |
| 4,609,431 | 9/1986 | Grose et al. | 162/135 |
| 5,152,872 | 10/1992 | Racine et al. | 162/184 |
| 5,242,545 | 9/1993 | Bradway et al. | 162/135 |
| 5,292,391 | 3/1994 | Wallick | 156/205 |

FOREIGN PATENT DOCUMENTS

| | | | |
|---|---|---|---|
| 450523 | 8/1948 | Canada | 162/172 |

OTHER PUBLICATIONS

George L. Booth "Coating equipment and Processes", Lockwood Publishing Co., Inc. pp. 158–162 and 452–453, Jan. 1970.

Kellicutt et al., "strength evaluations of corrugated containers by the drop test method", TAPPI, vol. 39, No. 9, pp. 62A–70A, Sep. 1956.

Trosset et al., "A study of some factors which affect the stiffness of folding boxboard", TAPPI, vol. 41, No. 3, pp. 177A–186A, Mar. 1958.

Krasniewski, Jr., J., "Paper Coating Additives", *Tappi Press,* 1995, p. 74.

*Primary Examiner*—Stanley S. Silverman
*Assistant Examiner*—José A. Fortuna
*Attorney, Agent, or Firm*—Foley, Hoag & Eliot LLP

[57] ABSTRACT

Making paper for corrugating medium includes forming a sheet of pulp material, partially drying the sheet of pulp material to provide a partially dried sheet, applying a crack-reducing agent to surfaces of the partially dried sheet, and providing a sheet of paper by drying the partially dried sheet after applying the crack-reducing agent. Forming a sheet of pulp material may include providing a pulp slurry to a headbox having a slice and carrying the pulp slurry that exits from the slice away from the headbox using, for example, a Fourdrinier. The Fourdrinier may also dry the sheet.

15 Claims, 4 Drawing Sheets

PAPER FOR CORRUGATING MEDIUM

TECHNICAL FIELD

This application relates to the field of making paper and more particularly to the field of making paper that is used for corrugating medium.

BACKGROUND OF THE INVENTION

Corrugated board is made by attaching one or more flat sheets of paper to a medium, a wavy or fluted section of paper. The medium may be formed using any one of a variety of conventional and well-known corrugation processes that provide any one of a variety of flute sizes. In applications that call for relatively small flute sizes, corrugating the medium sometimes results in cracks forming in the paper. In addition, when only one flat sheet is attached to the medium, such as in the case of certain types of gift boxes, then the cracks become visible and aesthetically unappealing. Many solutions to this problem have been suggested in the prior art, as described below.

U.S. Pat. No. 3,687,767 to Reisman et al. discloses preventing cracks in corrugating medium by first treating the paper with a resin and then drying the resin. The paper is then corrugated and, following that, is heat treated to cure the resin. This curing step is shown in the flow chart of FIG. 1 of Reisman et al. in the fourth step from the bottom. Similarly, U.S. Pat. No. 3,173,829 to Thier et al. is directed to a process in which an additive is provided to the paper pulp prior to the sheet forming and drying process. After the paper has been manufactured, the additive (bonding agent) is activated by heat and/or pressure.

Both the Reisman et al. and Thier et al. schemes require an extra curing or activating step after the paper has been manufactured. This may be impractical in some situation such as, for example, a large corrugated board manufacturing operation that is not readily equipped to incorporate this extra step into their process. In addition, in cases where curing or activation is provided by heat, an inadvertent and premature exposure of the product to heat may cause undesirable results.

U.S. Pat. No. 3,033,708 to McKee, U.S. Pat. No. 3,307,994 to Scott, Jr., U.S. Pat. No. 3,308,006 to Kresse et al., U.S. Pat. No. 3,518,216 to Harvey et al., U.S. Pat. No. 3,659,772 to Dorsey et al., and U.S. Pat. No. 4,038,122 to DeLigt are all directed to applying an additive to the finished paper product during, or just prior to, corrugation in order to prevent cracks during the corrugation process. However, applying the additive to the finished paper product adds another step and requires extra machinery located either at the corrugator or at the paper manufacturer. In addition, applying an additive to the finished paper product can create difficulties with respect to handling any excess additive that does not adhere to the paper.

U.S. Pat. No. 3,109,769 to Martin, U.S. Pat. No. 3,119,731 to Ströle et al., U.S. Pat. No. 3,298,902 to Osborg et al., and U.S. Pat. No. 3,525,668 to Goldstein et al. all appear to be directed to providing an additive to the pulp during the paper manufacturing process. Although this arguably avoids the need for extra equipment to apply the additive, it does result in a relatively large amount of additive being used since the additive ends up being applied throughout the entirety of the paper, rather than just at the surfaces.

In chapter 7 of a 1995 textbook titled "Paper Coating Additives" published by Tappi Press of Atlanta, Ga., the author suggests that dilutions of oxidized polyethylene emulsions have been applied at a size press or through surface spraying to lower surface coefficient of friction. The author goes on to state that spraying the oxidized polyethylene emulsions in the manufacture of corrugating medium decreases cracking during the corrugation step. However, since the author suggests only spraying to reduce cracking (as opposed to applying the emulsion with a size press to improve the coefficient of friction), this solution is similar to the solutions in references discussed above that disclose applying an additive after the paper manufacturing process is complete or just prior to corrugation.

It is desirable, therefore, to prevent cracks in the corrugated bound medium in an economical and feasible manner.

SUMMARY OF THE INVENTION

According to the present invention, making paper for a corrugating medium includes forming a sheet of pulp material, partially drying the sheet of pulp material to provide a partially dried sheet, applying a crack-reducing agent to surfaces of the partially dried sheet, and providing a sheet of paper by drying the partially dried sheet after applying the crack-reducing agent. The partially dry sheet may contain between 1% and 25% (by weight) moisture and, in a preferred embodiment, the partially dry sheet contains between 5% and 8% moisture. Forming a sheet of pulp material may include providing a pulp slurry to a headbox having a slice and carrying the pulp slurry that exits from the slice away from the headbox using, for example, a Fourdrinier. The Fourdrinier may also partially dry the sheet.

The sheet may be partially dried by passing the sheet between rolls of a wet press or by passing the sheet between cans of a drying stage that may be filled with steam. Drying the sheet after applying the crack-reducing agent may include passing the sheet between cans of a drying stage where the cans may be filled with steam.

Applying a crack-reducing agent to surfaces of the partially dried sheet may include applying the crack-reducing agent to a roll that contacts a first surface of the sheet where the roll may rotate in a tray containing the crack-reducing agent or, alternatively, the crack reducing agent may be sprayed onto the roll. An applicator having holes through which the crack-reducing agent pours onto a second surface of the sheet may also be used. The crack-reducing agent may be applied using a size press and/or may be sprayed directly onto surfaces of the sheet. A wet calendar stack may be used to apply an additional amount of the crack-reducing agent to the paper.

DETAILED DESCRIPTION OF THE PREFERRED EMBODIMENTS

Figure 1:
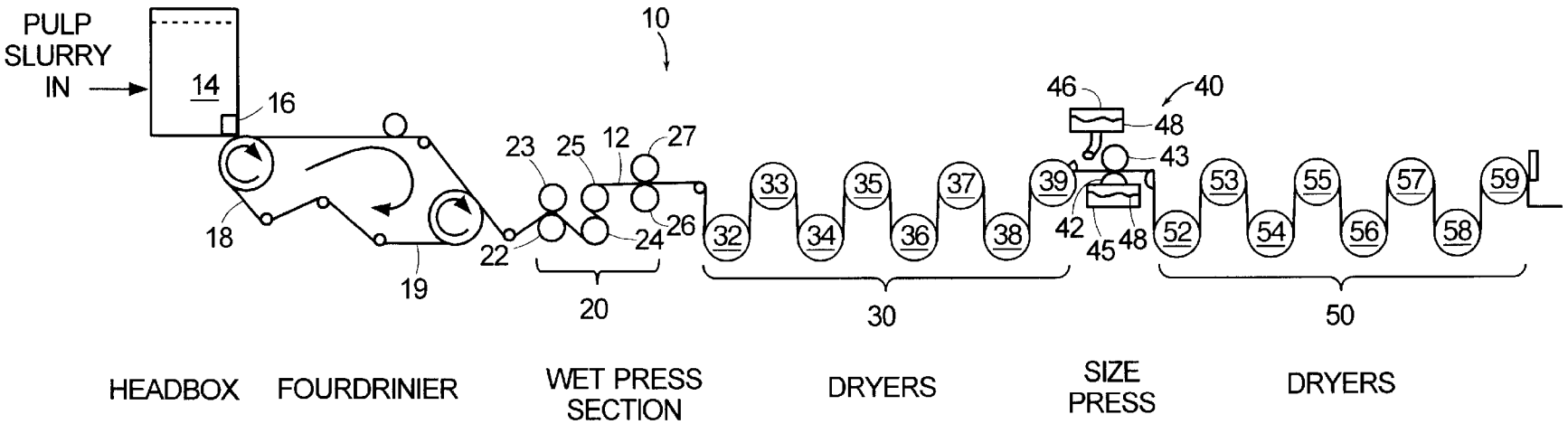
FIG. 1 is a schematic diagram illustrating a paper making process according to the invention.

Referring to FIG. 1, a schematic diagram 10 illustrates operation of a conventional Fourdrinier paper making machine that is modified and enhanced in a manner described in detail below. Note that although the invention is illustrated herein using a Fourdrinier paper making machine, it will be appreciated by one of ordinary skill in the art that it would be straight-forward to adapt the invention to other types of paper making machines.

The paper making machine provides a continuous sheet of paper 12 as an output. The sheet 12 may be rolled up at the output by conventional means (not shown) and then subsequently used to make corrugating medium in a conventional manner, such as by using a conventional corrugator to form flutes in the sheet 12.

A headbox 14 is provided with a pulp slurry containing any one of a variety of conventional combinations of hardwood pulp, softwood pulp, kraft pulp, sulfite soda pulp, ground wood, semi-ground wood, and/or semi-chemical or recycled pulp mixed with water and perhaps other conventional and well-known components that facilitate the paper making process. The specific combination of elements selected for the pulp slurry depends on a variety of functional factors familiar to one of ordinary skill in the art.

The pulp slurry exits from the headbox 14 via a slice 16 (a slit in the bottom front portion of the headbox 14). The pulp slurry thus forms a sheet of pulp onto a conventional Fourdrinier 18 which continuously turns in the direction illustrated by arrows shown thereon in order to carry the output from the slice 16 away from the headbox 14. The Fourdrinier 18 includes a wire mesh conveyor belt 19 that allows moisture from the sheet 12 to gravity drain, thus partially drying the sheet 12. A vacuum can also be applied underneath the wire mesh conveyor belt 19 to facilitate additional drying.

Following the conveyor belt 18 is a wet press section 20 which, in the embodiment illustrated herein, consists of six rolls 22–27 forming three presses. The wet press section 20 removes additional moisture from the sheet 12 by applying pressure thereto. The rolls 22, 23 cooperate to press liquid out of the sheet 12. Similarly, the rolls 24, 25 and the rolls 26, 27 cooperate to press additional moisture out of the sheet 12.

Following the wet press section 20 is a first drying stage 30 which includes a plurality of dryer cans 32–39. The dryer cans 32–39 are implemented in a conventional manner using hollow cylinders that may be filled with steam to heat the dryer cans 32–39. The sheet 12 winds around the dryer cans 32–39 as shown in FIG. 1 and is heated in order to remove additional moisture therefrom.

After the first drying stage 30, the sheet 12 is in a partially dry state. The partially dry sheet 12 may contain between 1% and 25% (by weight) of moisture. In a preferred embodiment, the partially dry sheet 12 contains between 5% and 8% moisture. Having the sheet 12 be partially dry facilitates the sheet 12 acquiring additional additives, as set forth in more detail below. However, if the amount of moisture contained in the partially dry sheet 12 is allowed to be too high, the sheet 12 will not have enough strength to withstand follow-on processing.

Following the first drying stage 30 is a size press 40 which includes a pair of rolls 42, 43, a tray 45 and an applicator 46. The partially dry sheet 12 passes between the rolls 42, 43 of the size press 40. The roll orientation is the angle of a tangent line formed at the point of contact of the rolls 42, 43. Other size presses having relative roll orientations different than that illustrated herein for the size press 40 may also be used.

The tray 45 contains a crack-reducing agent 48 that is applied to the lower surface of the sheet 12 by the roll 42. The roll 42 rotates through the crack-reducing agent 48 in the tray 45 and thus, as the sheet 12 moves through the size press 40, the crack-reducing agent 48 is transferred onto the lower surface of the sheet 12 by the roll 42. The applicator 46 also contains the crack-reducing agent 48. The applicator 46 pours the crack-reducing agent 48 onto the top portion of the sheet 12. The roll 43 then spreads the crack-reducing agent on the top portion of the sheet 12. Thus, the combination of the tray 45, the rolls 42, 43, and the applicator 46 apply the crack-reducing agent 48 to both surfaces of the sheet 12. Having the sheet 12 be partially dry prior to reaching the size press 40 facilitates absorption of the crack-reducing agent 48 by the sheet 12. If the sheet were completely dry upon reaching the size press 40, the crack-reducing agent 48 would not be absorbed as efficiently.

Following the size press 40 is a second drying stage 50 that includes a plurality of dryer cans 52–59. Operation of the second drying stage 50 is similar to operation of the first drying stage 30, described above, except that the drying stage 50 dries both the sheet 12 and dries the crack-reducing agent 48 that has been applied to the sheet 12 at the size press 40. In another embodiment different than that illustrated in FIG. 1, the first drying stage 30 has eighteen dryer cans and the second drying stage 50 has eight dryer cans.

Figure 2A:
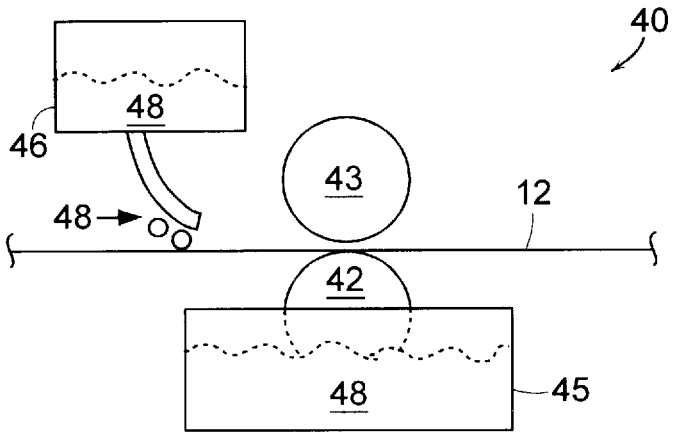
FIGS. 2A and 2B illustrate a size press used to apply a polymer emulsion according to the present invention.

Referring to FIG. 2A, the size press 40 is illustrated in greater detail. The sheet 12 passes between the rolls 42, 43. The applicator 46 applies the crack-reducing agent 48 to the upper surface of the sheet 12 while the roll 42 applies the crack-reducing agent 48 to the lower surface of the sheet 12. The crack-reducing agent 48 that is applied to the upper surface of the sheet 12 is spread onto the upper surface of the sheet 12 by the roll 43. Any excess crack-reducing agent 48 that is not taken up by the sheet 12 after passing through the rolls 42, 43 drips back into the tray 45.

Figure 2B:
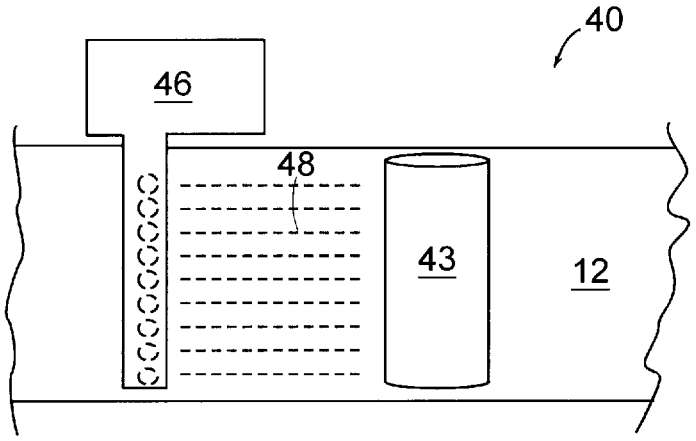

Referring to FIG. 2B, a schematic top view of the size press 40 illustrates application of the crack-reducing agent 48 to the upper surface of the sheet 12. The applicator 46 includes a pipe-like portion having holes in the underside thereof. The crack-reducing agent 48 pours through the holes in the pipe of the applicator 46 onto the sheet 12. The crack-reducing agent 48 that is thus applied to the upper surface of the sheet 12 is subsequently spread onto the upper surface of the sheet 12 by the roll 43.

Figure 3:
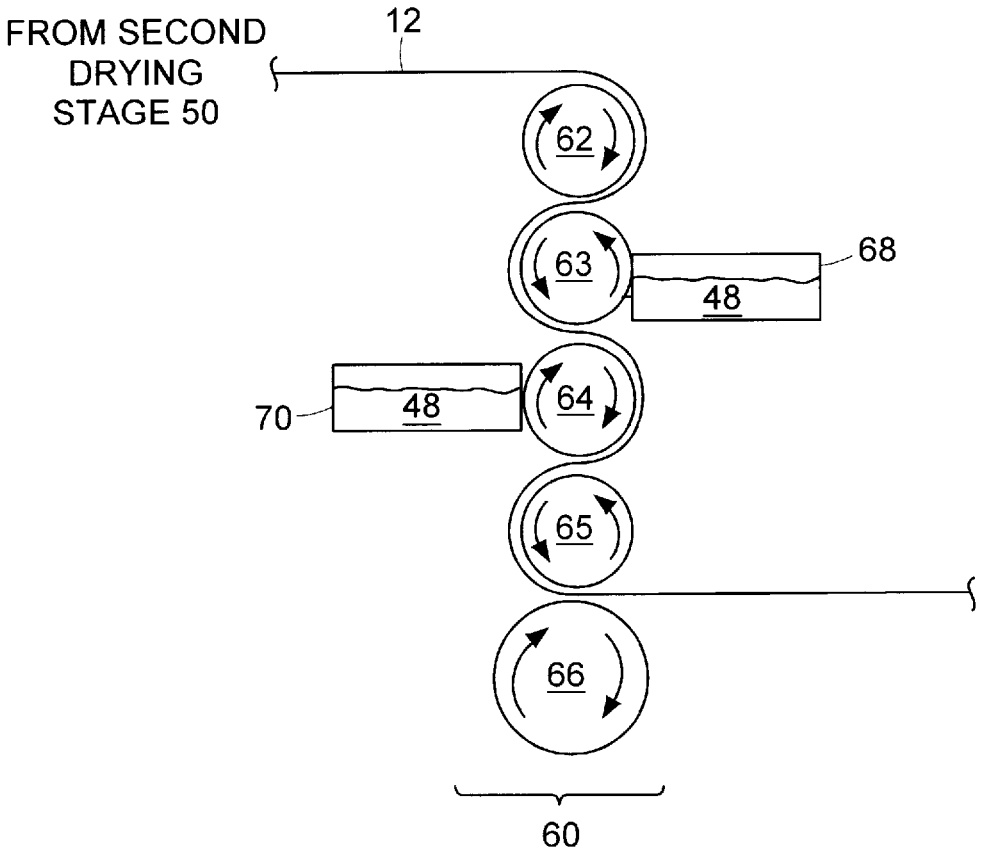
FIG. 3 is a schematic diagram of a wet calendar stack according to the present invention.

Referring to FIG. 3, a wet calendar stack 60 is optionally provided following the second drying stage 50. The wet calendar stack 60 includes a plurality of rolls 62–66 through which the sheet 12 is threaded in a serpentine fashion. The wet calendar stack 60 also includes a high-water box 68 and a low-water box 70, both of which contain the crack-reducing agent 48 (or perhaps a different crack-reducing agent than that applied at the size press 40). The high-water box 68 provides the crack-reducing agent 48 to a first surface of the sheet 12 by first applying the crack-reducing agent 48 to the roll 63 which then contacts the first surface of the sheet 12. Similarly, the low-water box 70 applies the crack-reducing agent 48 to a second surface of the sheet 12 by first applying the crack-reducing agent 48 to the roll 64 which contacts the second surface of the sheet 12. Optionally, the wet calendar stack 60 can be followed by one or more additional wet calendar stacks (not shown) and/or by one or more dry calendar stacks (not shown) that do not apply a crack-reducing agent to the sheet 12. The additional wet calendar stacks may apply the crack-reducing agent 48 and/or other additives to the sheet 12. In another embodiment not illustrated in FIG. 3, a wet calendar stack having six rolls followed by a dry calendar stack having eight rolls are used together. Applying additional amounts of the crack-reducing agent 48 using the wet calendar stack 60 allows the crack-reducing agent 48 to be applied in layers, thus facilitating a more even and perhaps thicker coating.

In a preferred embodiment, the crack-reducing agent 48 is manufactured using the following steps:

1. Place 900 gallons of water at ambient temperature into a mixing tank.
2. Add 250 milliliters of a defoamer such as Hercules Advantage 831 manufactured by Hercules Incorporated of Wilmington, Del.
3. Add 470 wet pounds of oxidized polyethylene wax emulsion such as ECC-3060 manufactured by the Eldorado Chemical Company, Inc. of San Antonio, Tex.
4. Add additional water so that the total volume in the mixing tank is 1,000 gallons.
5. Agitate the solution for five minutes to mix well.

The crack-reducing agent 48 is specifically formulated to reduce cracks when the paper is subsequently corrugated and may be manufactured via a plurality of alternative means. Alternative crack-reducing agents may comprise aqueous dispersions of metallic soaps, high solid lubricant blends containing calcium stearate soy-lecithin/oleic acid blends and mineral oil/sulfated petroleum oil blends. In addition, the waxes may be paraffin microcrystalline or oxidized polyethylene having either a high or a low density. The wax emulsion may be diluted with water in ratios between 0.25 and 20 percent.

Figure 4:
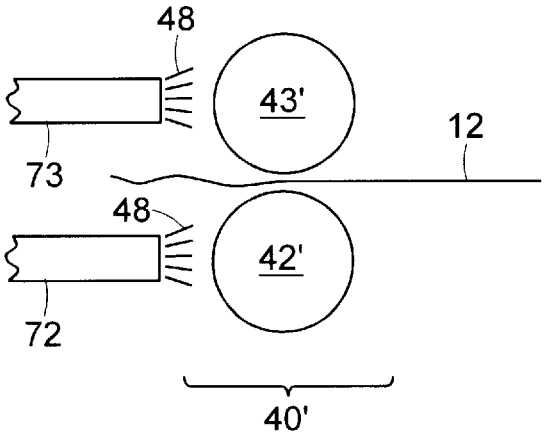
FIG. 4 is a schematic diagram of a size press in an alternative embodiment according to the present invention.

Referring to FIG. 4, an alternative size press 40' having rolls 42', 43' is shown. In the embodiment shown in FIG. 4, the crack-reducing agent 48 is applied directly to the roll 42' via a sprayer 72 while the crack-reducing agent 48 is applied directly to the roll 43' via a sprayer 73. The crack-reducing agent 48 thus sprayed onto the rolls 42', 43' is applied to surfaces of the sheet 12 by the rotating action of the rolls 42', 43'.

Figure 5:
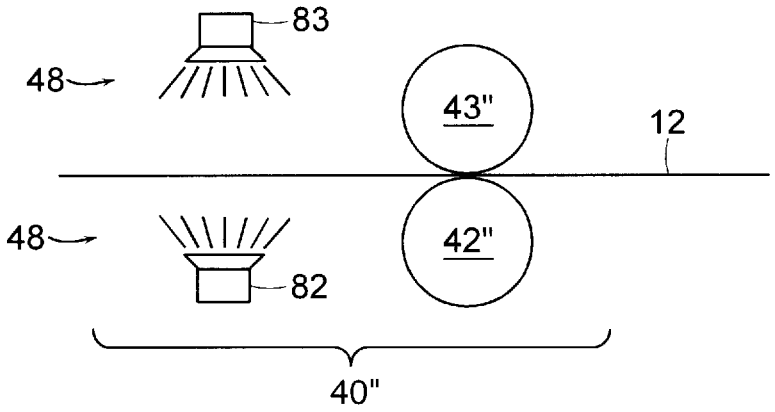
FIG. 5 is a schematic diagram of a size in an alternative embodiment according to the present invention.

Referring to FIG. 5, an alternative size press 40" uses two rolls 42", 43". The crack-reducing agent 48 is applied to the lower surface of the sheet 12 via a sprayer 82 and to the upper surface of the sheet 12 via a sprayer 83. The sprayers 82, 83 cooperate to provide the crack-reducing agent 48 simultaneously to both surfaces of the sheet 12. The applied crack-reducing agent 48 is subsequently spread onto the sheet 12 by the rolls 42", 43".

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A method of making paper for corrugating medium, comprising the steps of:

(a) forming a sheet of pulp material;

(b) partially drying the sheet of pulp material to provide a partially dried sheet;

(c) applying an effective amount of a crack-reducing agent to surfaces of the partially dried sheet, the crack-reducing agent being absorbed in the partially dry sheet, wherein the crack-reducing agent comprises a pigment-free polyethylene wax emulsion diluted with water in ratios between 0.25 and 20 percent, and wherein the crack-reducing agent is applied using a size press; and (d) drying the partially dried sheet after applying the crack-reducing agent to provide a sheet of paper for corrugating medium, whereby absorption of the crack-reducing agent inhibits formation of cracks when the paper is corrugated.

2. A method of making paper for corrugating medium, according to claim 1, wherein the partially dry sheet contains between 1% and 25% by weight of moisture.

3. A method of making paper for corrugating medium, according to claim 2, wherein the partially dry sheet contains between 5% and 8% by weight of moisture.

4. A method of making paper for corrugating medium, according to claim 1, wherein forming a sheet of pulp material comprises:

(e) providing a pulp slurry to a headbox having a slice; and (f) carrying the pulp slurry that exits from the slice away from the headbox.

5. A method of making paper for corrugating medium, according to claim 4, wherein the pulp slurry that exits from the slice is carried away by a Fourdrinier.

6. A method of making paper for corrugating medium, according to claim 1, wherein partially drying the sheet includes passing the sheet between rolls of a wet press.

7. A method of making paper for corrugating medium, according to claim 6, wherein partially drying the sheet further includes passing the sheet between cans of a drying stage.

8. A method of making paper for corrugating medium, according to claim 7, wherein the cans of the drying stage are filled with steam.

9. A method of making paper for corrugating medium, according to claim 1, wherein partially drying the sheet includes passing the sheet between cans of a drying stage.

10. A method of making paper for corrugating medium, according to claim 9, wherein the cans of the drying stage are filled with steam.

11. A method of making paper for corrugating medium, according to claim 1, wherein applying a crack-reducing agent to surfaces of the partially dried sheet includes applying the crack-reducing agent to a roll that contacts a first surface of the sheet.

12. A method of making paper for corrugating medium, according to claim 11, wherein applying the crack-reducing agent to a roll includes providing the crack-reducing agent in a tray through which the roll rotates.

13. A method of making paper for corrugating medium, according to claim 11, wherein applying the crack-reducing agent to a roll includes spraying the crack-reducing agent onto the roll.

14. A method of making paper for corrugating medium, according to claim 11, wherein applying the crack-reducing agent to surfaces of the partially dried sheet includes applying the crack-reducing agent to a second surface of the sheet using an applicator having holes therein through which the crack-reducing agent pours onto the second surface.

15. A method of making paper for corrugating medium, according to claim 1, further comprising the step of:

using a wet calendar stack to apply an additional amount of the crack-reducing agent to the paper.

* * * * *